US009410375B1

(12) United States Patent
Howe et al.

(10) Patent No.: US 9,410,375 B1
(45) Date of Patent: Aug. 9, 2016

(54) RAPID INSTALLATION AND REMOVAL LADDER SLIDE PREVENTION SYSTEM

(71) Applicants: Dennis Howe, Lisbon, ME (US); Kathy L Page, Lisbon, ME (US)

(72) Inventors: Dennis Howe, Lisbon, ME (US); Kathy L Page, Lisbon, ME (US)

( * ) Notice: Subject to any disclaimer, the term of this patent is extended or adjusted under 35 U.S.C. 154(b) by 474 days.

(21) Appl. No.: 13/926,177

(22) Filed: Jun. 25, 2013

Related U.S. Application Data

(60) Provisional application No. 61/668,086, filed on Jul. 5, 2012.

(51) Int. Cl.
*E06C 7/46* (2006.01)
*E06C 7/42* (2006.01)
*E06C 7/18* (2006.01)

(52) U.S. Cl.
CPC . *E06C 7/46* (2013.01); *E06C 7/188* (2013.01); *E06C 7/42* (2013.01)

(58) Field of Classification Search
CPC ..... E06C 7/42; E06C 7/423; E06C 7/44; E06C 7/46; E06C 7/188; E06C 7/18; E06C 7/08
See application file for complete search history.

(56) References Cited

U.S. PATENT DOCUMENTS 409,711 A * 8/1889 Sickles ..... E06C 7/44 182/204
1,346,831 A * 7/1920 Lehmann ..... E06C 7/44 182/111
2,127,035 A 8/1938 Kirlin et al.
2,360,640 A * 10/1944 Bengert ..... E06C 7/44 182/204
2,567,989 A * 9/1951 Cheek ..... E06C 7/081 182/111
2,581,782 A * 1/1952 Anderson ..... E06C 7/44 182/204
4,606,432 A * 8/1986 Belt ..... E06C 7/44 182/204
4,607,726 A * 8/1986 Davis ..... E06C 7/44 182/204
4,836,331 A 6/1989 Foradori
5,232,067 A * 8/1993 Griffith ..... E06C 7/44 182/201
D343,907 S 2/1994 Porter
5,865,268 A 2/1999 Finneran
6,935,463 B2 8/2005 Brewster
2005/0067224 A1* 3/2005 Brewster ..... E06C 7/46 182/108
2006/0169535 A1* 8/2006 Phillips ..... E06C 1/39 182/119
2006/0201746 A1* 9/2006 Jackson ..... E06C 7/003 182/204
2007/0119656 A1* 5/2007 Scott ..... E06C 7/44 182/200
2007/0261918 A1* 11/2007 Trebec ..... E06C 7/423 182/172
2008/0000720 A1* 1/2008 Porch ..... E06C 7/46 182/107

* cited by examiner

*Primary Examiner* — Christopher M Koehler
(74) *Attorney, Agent, or Firm* — RG Patent Consulting, LLC; Rachel Gilboy

(57) ABSTRACT

A rapid installation and removal ladder slide prevention system is an easily installed and removed ladder slide prevention device that may be installed without the use of hand tools. The system may include an upper and a lower U-shaped bracket for each ladder leg that are slid onto the legs and secured by a bolt through the legs of the U-shaped bracket and are each locked into place with a wing nut. A cylindrical sleeve is attached to the back of each U-shaped bracket. A sharpened leg stake is able to be slid through the two sleeves on the two U-shaped brackets on each ladder leg and each adjusted in length in relation the ladder feet, and locked into place by an R-clip passed through holes in the lower bracket sleeves on each lower U-shaped bracket. The device increases ladder safety for users.

17 Claims, 5 Drawing Sheets

RAPID INSTALLATION AND REMOVAL LADDER SLIDE PREVENTION SYSTEM

CROSS-REFERENCE TO RELATED APPLICATION

The present application is related to and claims priority from prior provisional application Ser. No. 61/668,086, filed Jul. 5, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of ladder anti-slip devices and more specifically relates to a rapid installation and removal ladder slide prevention system.

2. Description of the Related Art

A ladder is a vertical or inclined set of rungs or steps. The most common types of ladders are rigid and can be leaned against a vertical surface such as a wall. The vertical members of a rigid ladder are called stringers or rails or stiles. Rigid ladders are usually portable, but some types are permanently fixed to buildings. They are commonly made of metal, wood, or fiberglass, but they have been known to be made of tough plastic. Portable industrial ladders are made of fiberglass for electrical arc prevention. Nearly all ladders manufactured for sale today have some sort of feet attached for added stability. The feet often swivel so that the bottoms of the feet can be placed flat against the floor or ground surface to provide greater ground contact surface area. Rubber grips on the bottoms of the ladder feet are designed to add a degree of grip so that the bottoms of the feet do not slide away from the vertical surface the ladder is leaned against. Often though, the ladder feet can still slip and move on certain types of surfaces. When the rubber grips become hardened, they tend to cause sliding rather than preventing it. This is not desirable.

Fatalities are added to statistics annually because of falls from ladders. The most common injury made by ladder climbers is bruising from falling off the ladder, and so for safety, a rigid ladder should be leaned at an angle of about fifteen degrees to the vertical. In other words, the distance from the foot of the ladder to the wall should be about one quarter of the height of the top of the ladder. At steeper angles, the ladder is at risk of toppling backwards when the climber leans away from it. At shallower angles, the ladder may lose its grip on the ground. The correct angle is difficult for inexperienced users to judge. Even experienced users make the mistake of placing the bottom of the ladder on incompatible gripping surfaces. On softer ground surfaces, even ladder feet in good condition can be unstable because of uneven or soft ground. Harder surfaces tend to promote sliding rather than maintaining a grip.

Different methods have been used to stabilize ladders, many with permanent attachments. Federal statutes regulate methods that involve permanent attachments to ladders. Drilling holes in a ladder to install add-on equipment that is not made for or designed by the ladder manufacturer for a particular ladder is generally unacceptable due to possible weakening of the ladder rails. A registered engineer must provide documentation specifying that modification designs and installation method are safe, which makes most methods illegal in industrial environments. Ladders are rarely, if ever, manufactured with non-slip equipment beyond the feet rubber grips. A quickly installable non-slip system that does not alter the structure of the ladder is needed in the interest of worker safety.

Various attempts have been made to solve the above-mentioned problems such as those found in U.S. Pat. Nos. 6,935,463; D343907; 4,836,331; 1,346,831; 2,127,035; and 5,865,268. This art is representative of ladder anti-slip devices. None of the above inventions and patents, taken either singly or in combination, is seen to describe the invention as claimed.

Ideally, a ladder anti-slip device should provide ease of installation and removal and, yet would operate reliably and be manufactured at a modest expense. Thus, a need exists for a reliable rapid installation and removal ladder slide prevention system to rapidly install and remove a ladder slip prevention device to promote safety and to avoid the above-mentioned problems.

BRIEF SUMMARY OF THE INVENTION

In view of the foregoing disadvantages inherent in the known ladder slip prevention art, the present invention provides a novel rapid installation and removal ladder slide prevention system, entitled Ladder Stand Up Helper. The general purpose of the present invention, which will be described subsequently in greater detail, is to provide rapid installation and removal of a ladder slip prevention device such that the ladder structure is not compromised, yet realizes greater stability for the ladder during use in a variety of terrains.

Rapid installation and removal ladder slide prevention system provides consumers with a safety device for ladders. The invention is comprised of two upper and two lower U-brackets, two first and two second bracket bolts, four wing nuts, two R-clips and two leg stakes, one for each side of the ladder if two anti-slide assemblies are used. The user puts the lower U-bracket with the hitch pin clip under the first step of the ladder on the outside rail. The upper U-bracket is then installed above the first step and the leg stake is slid through both the first stake sleeve and second stake-sleeve and the R-clip slid through the aligning through-hole of the sleeve and stake-through-hole. The rod can be adjusted for hard ground and grass or can be made to go deeper for sandy ground. There are six adjustment holes spaced every two inches in preferred embodiments for suitable adjustability. The unit may be made from metal, aluminum, or other suitable material. It may be approximately 6" tall, 1.5" wide, and have ¾" tubing on the top. The rod may be 18" long and ½" thick. The brackets may be about ⅛" thick.

The rapid installation and removal ladder slide prevention system is preferably a set of two identical U-bracket units that attach to one (first) ladder leg and together secure a pointed stake through a sleeve on each U-bracket to position the point of the spike at a user preferred distance below the foot of the ladder leg. A second identical assembly may attach to a second ladder leg. The rapid installation and removal ladder slide prevention system may be described as a single assembly meaning one upper U-bracket and one lower U-bracket for attachment to a single leg of a ladder, or may refer to one assembly having two identical upper U-brackets and two identical lower U-brackets for attachment to two legs of a ladder. For purposes of clarification, a description of a four unit assembly is provided first.

The rapid installation and removal ladder slide prevention system may comprise an anti-slide assembly having a left-side upper U-bracket having left-upper clamp holes, a first stake sleeve, a first bracket bolt and a first wing nut, a left-side lower U-bracket having left-lower clamp holes, a second stake sleeve having a through-hole, a second bracket bolt, a second wing nut and a left R-clip, a left leg stake having a point end and a top end and a plurality of stake-through-holes, a right-side upper U-bracket having right-upper clamp holes, a third stake sleeve, a third bracket bolt and a third wing nut, a right-side lower U-bracket having right-lower clamp holes, a fourth stake sleeve having a through-aperture, a fourth bracket bolt and a fourth wing nut, a right R-clip, a right leg stake having a traction end and an upper end, and a plurality of stake-through-orifices.

The left-side upper U-bracket is removably fastened to a ladder left leg near the bottom portion of the left leg. The first stake sleeve is non-removably attached to the outside back portion of the left-side upper U-bracket such that the first stake sleeve is oriented vertically. The first bracket bolt is horizontally inserted through two corresponding left-upper clamp holes of the left-side upper U-bracket such that the first wing nut (other fastening means may be used) is able to be threadably fastened onto the first bracket bolt to biasingly clamp the left-side upper U-bracket to the ladder left leg. The left-side lower U-bracket is removably fastened to the ladder left leg vertically beneath the left-side upper U-bracket.

The second stake sleeve is non-removably attached to the outside back portion of the left-side lower U-bracket such that the second stake sleeve is oriented vertically. The second bracket bolt is horizontally inserted through the left-lower clamp holes of the left-side lower U-bracket such that the second wing nut is able to be threadably fastened onto the second bracket bolt to biasingly clamp the left-lower U-bracket to the ladder left leg. The point end of the left leg stake is slideably inserted vertically downward first through the first stake sleeve and secondly through the second stake sleeve aligning the through-hole of the second stake sleeve with a single stake-through-hole of the left leg stake and biasingly inserting the left R-clip through the through-hole and the stake-through-hole to removably secure the left leg stake to the ladder left leg. The right-side upper U-bracket is removably fastened to the ladder right leg near the bottom portion.

The third stake sleeve is non-removably attached to the outside back portion of the right-side upper U-bracket such that the third stake sleeve is oriented vertically. The third bracket bolt is horizontally inserted through the right-upper clamp holes of the right-side upper U-bracket such that the third wing nut is able to be threadably fastened onto the third bracket bolt to biasingly clamp the right-side upper U-bracket to the ladder right leg. The right-side lower U-bracket is removably fastened to the ladder right leg vertically beneath the right-side upper U-bracket.

The fourth stake sleeve is non-removably attached to the outside back portion of the right-side lower U-bracket such that the fourth stake sleeve is oriented vertically. The fourth bracket bolt is horizontally inserted through the right-lower clamp holes of the right-side lower U-bracket such that the fourth wing nut is able to be threadably fastened onto the fourth bracket bolt to biasingly clamp the right-lower U-bracket to the ladder right leg. The traction end of the right leg stake is slideably inserted vertically downward first through the third stake sleeve and secondly through the fourth stake sleeve aligning the through-aperture of the fourth stake sleeve with a single stake-through-orifice of the right leg stake and biasingly inserting the right R-clip through the through-aperture and the stake-through-orifice to removably secure the right leg stake to the ladder right leg. The anti-slide assembly is useful for removably and adjustably attaching to a ladder left leg and a ladder right leg such that the left leg stake and the right leg stakes are able to penetrate the ground surface in combination (but independently adjustable), to prevent the bottom of the ladder from unintentionally sliding outward while the user is climbing, thereby increasing the safety of the user.

The following is now referring to a preferred description of a single assembly having two identical U-bracket units for installation on a single leg of a ladder, however, it should be understood that two identical assemblies, one for each leg of the ladder, provides optimum safety from sliding, thus one of each assembly may be mounted to a right ladder leg and a right ladder leg respectively for use. In this description, the rapid installation and removal ladder slide prevention system may comprise at least one anti-slide assembly having an upper U-bracket having a plurality of first and second upper clamp holes, a first stake sleeve, a first bracket bolt and a first wing nut, a lower U-bracket having a plurality of third and a fourth lower clamp holes, a second stake sleeve having a through-hole, a second bracket bolt, a second wing nut and an R-clip, and a leg stake having a point end, a top end, and a plurality of stake-through-holes. A single anti-slide assembly is removably attached to each leg of a ladder, each anti-slide assembly being identical and interchangeable to attach to any leg of a ladder. One anti-slide assembly fastened to each leg of a ladder is able to provide an added measure of safety for the user.

The upper U-bracket is removably fastened to a ladder leg near the bottom portion of the leg. The first stake sleeve is non-removably attached to the outside back portion of the upper U-bracket such that the first stake sleeve is oriented vertically and parallel with the ladder rails. The centerline of the first stake sleeve and the second stake sleeve are non-removably and perpendicularly attached to the outside back portion of the upper U-bracket and the lower U-bracket respectively. The first bracket bolt is horizontally inserted through the upper clamp holes of the upper U-bracket such that the first wing nut is able to be threadably fastened onto the first bracket bolt to biasingly clamp the upper U-bracket to the ladder leg. The upper U-bracket and the lower U-bracket each comprise an inner arm and an outer arm.

The plurality of first clamp holes of the inner arm correspond with the plurality of second clamp holes of the outer arm of the upper U-bracket and the lower U-bracket respectively such that the upper U-bracket and the lower U-bracket are each able to be fastened to various sizes of the leg(s) of different ladders via the first bracket bolt and the second bracket bolt. The inner arm and the outer arm of the upper U-bracket each comprise about 3 sets of first and second upper clamp holes (more or less may be used however three sets is preferred).

The upper U-bracket and the lower U-bracket each comprise an open end such that the upper and the lower U-brackets are able to be slideably placed onto the leg of the ladder. The width of the inside dimension between the inner arm and the outer arm of the upper U-bracket and the lower U-bracket is greater than the outside dimension of the thickness of the leg of the ladder such that the upper U-bracket and the lower U-bracket each has a loose frictional fit on the leg of the ladder. The lower U-bracket is removably fastened to the ladder leg vertically beneath the upper U-bracket. The upper U-bracket and the lower U-bracket are oriented perpendicular to a longitudinal edge of the leg of the ladder when the anti-slide assembly is attached to the ladder.

The second stake sleeve is non-removably attached to the outside back portion of the lower U-bracket such that the second stake sleeve is oriented vertically. The second bracket bolt is horizontally inserted through the lower clamp holes of the lower U-bracket such that the second wing nut is able to be threadably fastened onto the second bracket bolt to biasingly clamp the lower U-bracket to the ladder leg. The point end of the leg stake is slideably inserted vertically downward first through the first stake sleeve and secondly through the second stake sleeve aligning the through-hole of the second stake sleeve with a single stake-through-hole of the leg stake and biasingly inserting the R-clip through the through-hole and the stake-through-hole to removably secure the leg stake to the ladder leg. The point end of the leg stake comprises a sharpened end such that the point end is able to penetrate a ground surface. The leg stake may comprise about 6 stake-through-holes which may be spaced about 2 inches apart.

The anti-slide assembly is able to be quickly installed on a ladder without the use of any hand tools and may be moved from one ladder to another quickly. The leg stake is preferably about ½ inch in diameter and about 18 inches long such that the upper U-bracket and the lower U-bracket are able to be installed on different ladders having various spacing requirements. The exact diameter and length of the leg stake may vary. The leg stake is oriented adjacently parallel to a narrow edge of a leg of the ladder when the anti-slide assembly is attached to the ladder so that it is either on a front facing side or a back facing side.

The point end of the leg stake is able to be adjusted vertically upward or vertically downward in relation to a foot of the leg of the ladder via one of the stake-through-holes aligned with the through-hole of the second stake sleeve, and the leg stake(s) slideably locked into place via R-clip(s). The at least one anti-slide assembly is useful for removably and adjustably attaching to the legs of a ladder such that at least one leg stake is able to penetrate a ground surface to prevent the bottom of a ladder from unintentionally sliding outward and falling while a user is climbing on it, thereby adding to the safety of the user. The point end of the leg stake(s) in relation to a hard floor surface, such as concrete, may be adjusted slightly below the surface edge of the foot of the ladder to apply pressure to the point of the leg stake such that weight is applied to the foot of the ladder as well as the point of the leg stake, thereby increasing the grip of the feet to the floor or ground surface.

The rapid installation and removal ladder slide prevention system further may comprise a kit having at least one anti-slide assembly having an upper U-bracket with a first bracket bolt and a first wing nut, a lower U-bracket having a second bracket bolt, a second wing nut, and an R-clip, a leg stake, and at least one set of user instructions.

A method of using the rapid installation and removal ladder slide prevention system may comprise the steps of sliding at least one lower U-bracket onto at least one leg of a ladder, inserting at least one second bracket bolt through a third lower clamp hole and through a corresponding fourth lower clamp hole of at least one lower U-bracket, threadably fastening at least one second wing nut onto at least one second bracket bolt, sliding at least one upper U-bracket onto the leg of the ladder, inserting at least one first bracket bolt through a first upper clamp hole and through a corresponding second upper clamp hole of the upper U-bracket, threadably fastening at least one first wing nut onto at least one first bracket bolt, adjustably-sliding a leg stake through a first stake sleeve and a second stake sleeve respectively with the point end of the leg stake oriented downwardly, aligning a through-hole of the second stake sleeve with a user preferred stake-through-hole of the leg stake, inserting an R-clip, using the ladder, and storing the ladder. The present invention may be removed from the ladder if use is not needed.

The present invention holds significant improvements and serves as a rapid installation and removal ladder slide prevention system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, rapid installation and removal ladder slide prevention system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a ladder slip prevention device and more particularly to a rapid installation and removal ladder slide prevention system as used to improve the speed and ease of installing a ladder slide prevention device without requiring the use of hand tools.

Generally speaking, the rapid installation and removal ladder slide prevention system is an easily installed and removed ladder slide prevention device that may be installed without the use of hand tools. The system may comprise an upper and a lower U-shaped bracket for each ladder leg that are slid onto the legs and secured by a bolt through the legs of the U-shaped bracket and are each locked into place with a wing nut. A cylindrical sleeve is attached to the back of each U-shaped bracket. A sharpened leg stake is able to be slid through the two sleeves on the two U-shaped brackets on each ladder leg and each adjusted in length in relation the ladder feet, and locked into place by an R-clip passed through holes in the lower bracket sleeves on each lower U-shaped bracket.

Figure 1:
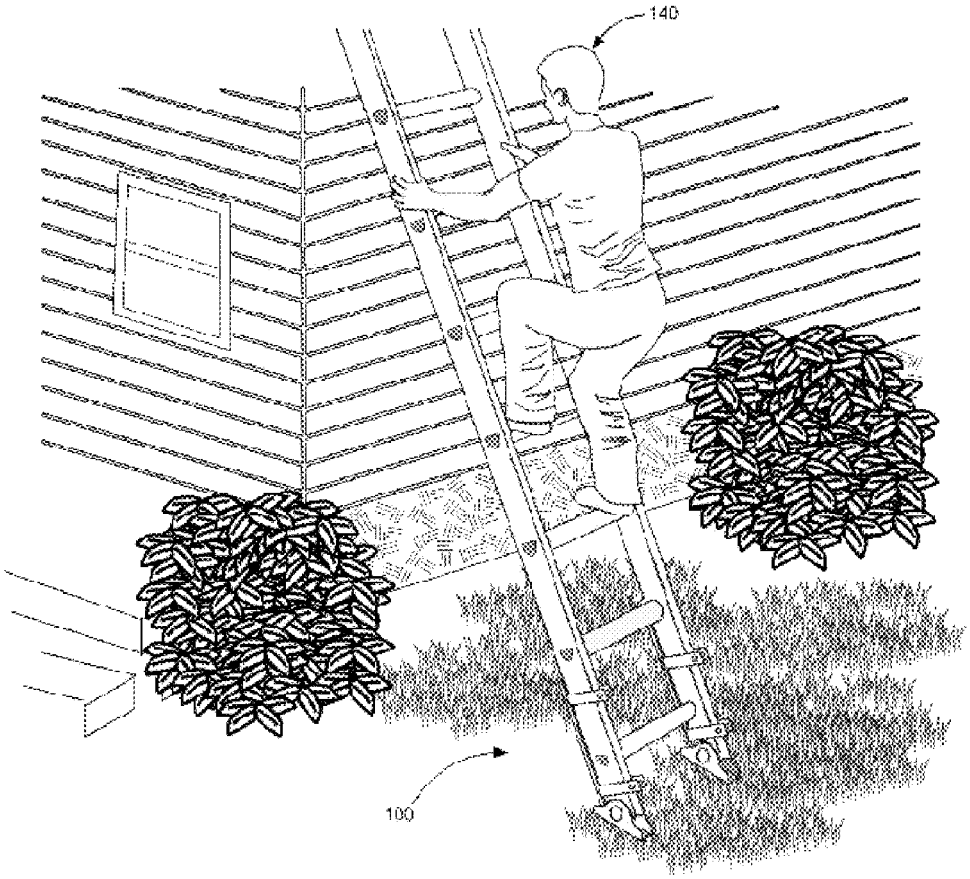
FIG. 1 shows a perspective view illustrating an in-use condition of a rapid installation and removal ladder slide prevention system according to an embodiment of the present invention.

Referring to the drawings by numerals of reference there is shown in FIG. 1, a perspective view illustrating an in-use condition of rapid installation and removal ladder slide prevention system 100 according to an embodiment of the present invention.

At least one anti-slide assembly 105 is useful for removably and adjustably attaching to leg(s) 110 of ladder 120 such that at least one leg stake 130 is able to penetrate the ground surface to prevent the bottom of ladder 120 from unintentionally sliding outward and falling while user 140 is climbing ladder 120, thereby adding to the safety of user 140. Rapid installation and removal ladder slide prevention system 100 provides user 140 with a measure of added safety when used with free standing two leg ladders 120. The invention may also be used with three or four leg A-frame type step-ladders.

The present invention preferably comprises two identical assemblies (for ease of manufacturing), each having one upper U-bracket(s) 150 and one lower U-bracket(s) 160, first bracket bolt(s) 170 and second bracket bolt(s) 180, first wing nut(s) 190 and second wing nut(s) 195, R-clip(s) 199 and leg stake(s) 130, one of each for each leg 110 of ladder 120 (if two anti-slide assembly(s) 105 are used). User 140 puts lower U-bracket(s) 160 with R-clip 199 under the first step of ladder 120 on ladder rail(s) 250. Upper U-bracket(s) 150 is then installed above the first step of ladder 120 and leg stake 130 is slid through both first stake sleeve 200 and second stake-sleeve 205 and R-clip(s) 199 slid through the aligning through-hole 207 of second stake-sleeve 205 and stake-through-hole 132. Stake-through-hole 132 can be adjusted for hard ground, grass, or can be made to go deeper for sandy locations. There are six stake-through-hole(s) 132 spaced every two inches in preferred embodiments; however alternate embodiments may use more or less stake-through-hole(s) 132.

Anti-slide assembly(s) 105 may be made from ferrous metal, aluminum, or another suitably durable material. Anti-slide assembly(s) 105 may be made of ⅛ inch thick by 3 inches wide flat strap metal but may be thicker or wider. Leg stake(s) 130 may be 18" long and ½" thick and first stake sleeve 200 and second stake-sleeve 205 may be cylindrical and sized such that leg stake(s) 130 may slide through with minimal clearance.

Figure 2:
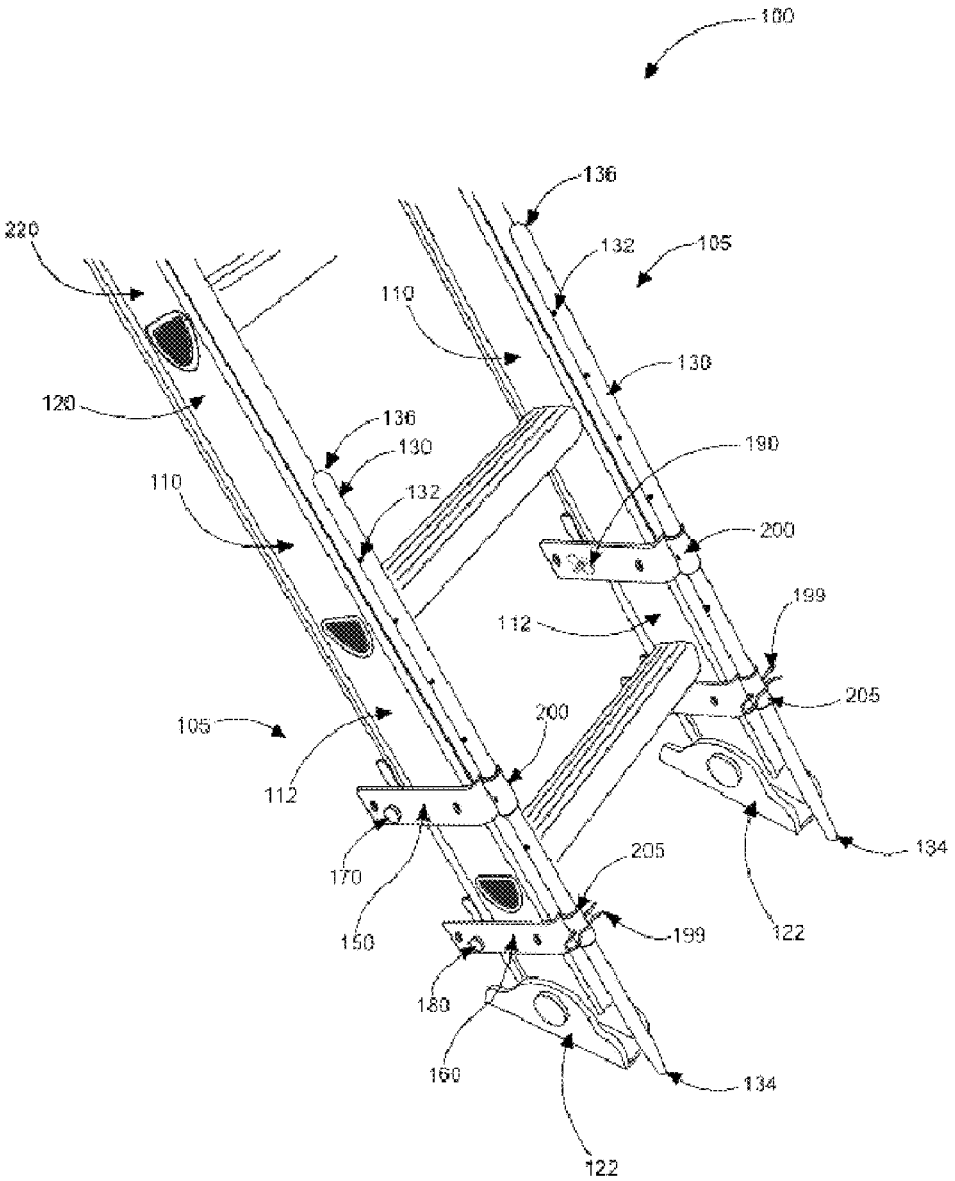
FIG. 2 is a perspective view illustrating two installed rapid installation and removal ladder slide prevention systems as installed on a ladder according to an embodiment of the present invention of FIG. 1.

Referring now to FIG. 2, a perspective view illustrating two installed anti-slide assembly(s) 105 on ladder 120 according to an embodiment of the present invention of FIG. 1.

Rapid installation and removal ladder slide prevention system 100 may comprise at least one anti-slide assembly(s) 105 having upper U-bracket(s) 150 having a plurality of first 230 and second upper clamp holes 232, first stake sleeve 200, first bracket bolt(s) 170 and first wing nut 190, lower U-bracket(s) 160 having a plurality of third 240 and fourth lower clamp holes 242, second stake-sleeve 205 having through-hole 207, second bracket bolt(s) 180, second wing nut 195 and R-clip(s) 199, and leg stake(s) 130 having point end 134, top end 136, and plurality of stake-through-hole(s) 132. A single anti-slide assembly 105 is removably attached to each leg 110 of ladder 120, each anti-slide assembly 105 being identical and interchangeable to attach to either leg 110 of ladder 120. One anti-slide assembly(s) 105 fastened to each leg 110 of ladder 120 is able to provide an added measure of safety for user 140; each anti-slide assembly 105 being independently adjustable. Upper U-bracket(s) 150 is removably fastened to leg(s) 110 of ladder 120 near bottom portion 112 of leg(s) 110. First stake sleeve 200 is non-removably attached to the outside back portion of upper U-bracket(s) 150 such that first stake sleeve 200 is oriented vertically and parallel with ladder rail(s) 250.

Lower U-bracket(s) 160 is removably fastened to leg(s) 110 of ladder 120 vertically beneath upper U-bracket(s) 150. Upper U-bracket(s) 150 and lower U-bracket(s) 160 are oriented perpendicularly to a longitudinal edge of leg(s) 110 of ladder 120 when anti-slide assembly(s) 105 is attached to ladder 120. Second stake-sleeve 205 is non-removably attached to the outside back portion of lower U-bracket(s) 160 such that second stake-sleeve 205 is oriented vertically. Second bracket bolt(s) 180 is horizontally inserted through third 240 and fourth lower clamp holes 242 of lower U-bracket(s) 160 such that second wing nut 195 is able to be threadably fastened onto second bracket bolt(s) 180 to biasingly clamp lower U-bracket(s) 160 to leg(s) 110 of ladder 120.

Point end 134 of leg stake(s) 130 is slideably inserted vertically downward first through first stake sleeve 200 and secondly through second stake-sleeve 205 aligning through-hole 207 of second stake-sleeve 205 with a single stake-through-hole(s) 132 of leg stake(s) 130 and biasingly inserting R-clip(s) 199 through through-hole 207 and stake-through-hole(s) 132 to removably secure leg stake(s) 130 to leg(s) 110 of ladder 120. Point end 134 of leg stake(s) 130 comprises a sharpened end such that point end 134 is able to penetrate a ground surface. Leg stake(s) 130 may comprise about 6 stake-through-hole(s) 132 which may be spaced about 2 inches apart. Leg stake(s) 130 are each independently operable to differing lengths for varied terrain as needed.

Figure 3:
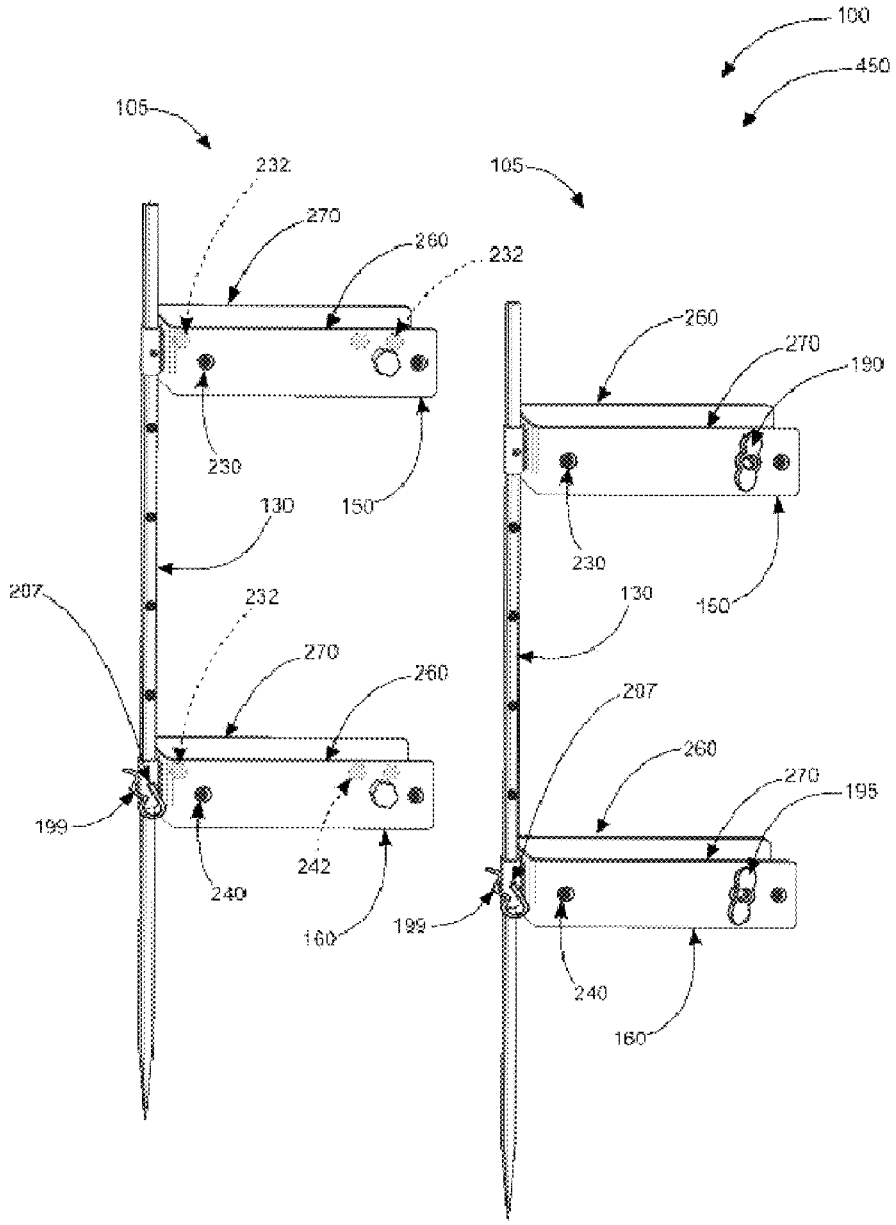
FIG. 3 is a perspective view illustrating an assembled rapid installation and removal ladder slide prevention system according to an embodiment of the present invention of FIG. 1.

Referring now to FIG. 3, a perspective view illustrating an assembled rapid installation and removal ladder slide prevention system 100 according to an embodiment of the present invention of FIG. 1.

The centerline of first stake sleeve 200 and second stake-sleeve 205 are non-removably and perpendicularly attached to the outside back portion of upper U-bracket(s) 150 and lower U-bracket(s) 160 respectively. First bracket bolt(s) 170 is horizontally inserted through first 230 and second upper clamp holes 232 of upper U-bracket(s) 150 such that first wing nut 190 is able to be threadably fastened onto first bracket bolt(s) 170 to biasingly clamp upper U-bracket(s) 150 to leg(s) 110 of ladder 120. Upper U-bracket(s) 150 and lower U-bracket(s) 160 each comprise inner arm 260 and outer arm 270.

The plurality of first upper clamp holes 230 of inner arm 260 correspond with the plurality of second upper clamp holes 232 of outer arm 270 of upper U-bracket(s) 150 respectively. The plurality of third lower clamp holes 240 of inner arm 260 correspond with the plurality of fourth lower clamp holes 242 of outer arm 270 of lower U-bracket(s) 150 such that upper U-bracket(s) 150 and lower U-bracket(s) 160 are each able to be fastened to various sizes of leg(s) 110 of different ladders 120 via first bracket bolt(s) 170 and second bracket bolt(s) 180. Inner arm 260 and outer arm 270 of upper U-bracket(s) 150 each comprise about 3 sets of first 230 and second upper clamp holes 232. Upper U-bracket(s) 150 and lower U-bracket(s) 160 each comprise an open end such that upper 150 and lower U-bracket(s) 160 are able to be slideably placed onto leg(s) 110 of ladder 120. The width of the inside dimension between inner arm 260 and outer arm 270 of upper U-bracket(s) 150 and lower U-bracket(s) 160 is greater than the outside dimension of the thickness of leg(s) 110 of ladder 120 such that upper U-bracket(s) 150 and lower U-bracket(s) 160 each have a loose frictional fit on leg(s) 110 of ladder 120.

Figure 4:
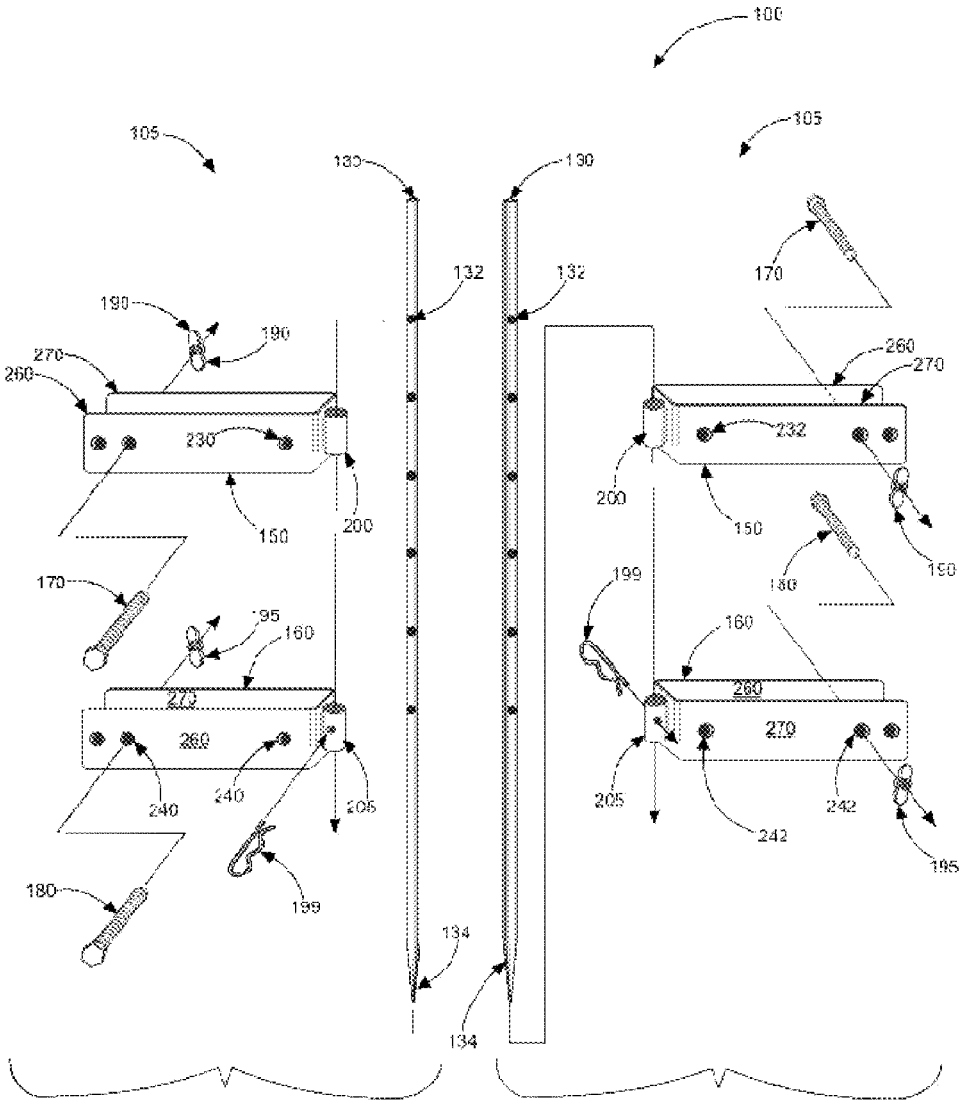
FIG. 4 is a perspective view illustrating a disassembled condition of the rapid installation and removal ladder slide prevention system according to an embodiment of the present invention of FIG. 1.

Referring now to FIG. 4, a perspective view illustrating a disassembled condition of rapid installation and removal ladder slide prevention system 100 according to an embodiment of the present invention of FIG. 1.

Anti-slide assembly(s) 105 is able to be quickly installed on ladder 120 without the use of any hand tools and may be adjusted or moved from one ladder 120 to another quickly and with relative ease. Leg stake(s) 130 is preferably about ½ inch in diameter and about 18 inches long such that upper u-bracket(s) 150 and lower u-bracket(s) 160 are able to be installed on different ladder 120 having various spacing requirements, but may vary in diameter and length in alternate embodiments. Leg stake(s) 130 is oriented adjacently parallel to a narrow edge of leg(s) 110 of ladder 120 when anti-slide assembly(s) 105 is attached to ladder 120 so that it is either on a front facing side or a back facing side. Point end 134 of leg stake(s) 130 is able to be adjusted vertically upward or vertically downward in relation to foot 122 of leg(s) 110 of ladder 120 via one of stake-through-hole(s) 132 aligned with through-hole 207 of second stake-sleeve 205, and leg stake(s) 130 slideably locked into place via R-clip(s) 199 at a desired height.

Rapid installation and removal ladder slide prevention system 100 may be sold as kit 450 comprising the following parts: at least one upper U-bracket(s) 150 with first bracket bolt(s) 170 and first wing nut 190; at least one lower U-bracket(s) 160 having second bracket bolt(s) 180, second wing nut 195, and R-clip(s) 199; at least one leg stake(s) 130; and at least one set of user instructions. Rapid installation and removal ladder slide prevention system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastener and attachment means and combinations, parts may be sold separately, etc., may be sufficient.

Figure 5:
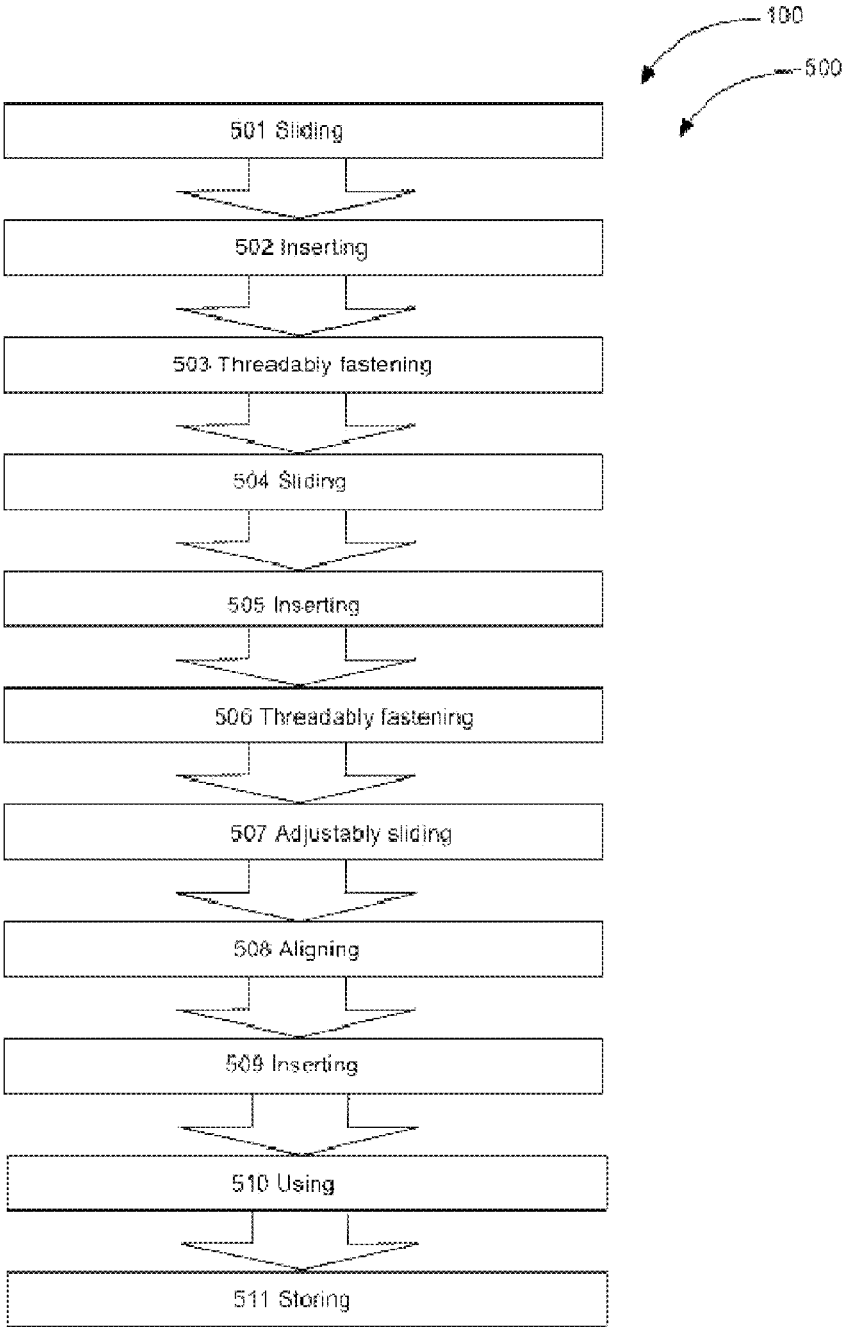
FIG. 5 is a flowchart illustrating a method of use of the rapid installation and removal ladder slide prevention system according to an embodiment of the present invention of FIGS. 1-4.

Referring now to FIG. 5, a flow chart illustrating method of use 500 for rapid installation and removal ladder slide prevention system 100.

Method of use 500 for rapid installation and removal ladder slide prevention system 100 may comprise the steps of: step one 501 sliding at least one lower U-bracket(s) 160 onto at least one leg(s) 110 of ladder 120; step two 502 inserting at least one second bracket bolt(s) 180 through third lower clamp holes 240 and through a corresponding fourth lower clamp holes 242 of at least one lower U-bracket(s) 160; step three 503 threadably fastening at least one second wing nut 195 onto at least one second bracket bolt(s) 180; step four 504 sliding at least one upper U-bracket(s) 150 onto at least one leg(s) 110 of ladder 120; step five 505 inserting at least one first bracket bolt(s) 170 through first upper clamp holes 230 and through a corresponding second upper clamp holes 232 of at least one upper U-bracket(s) 150; step six 506 threadably fastening at least one first wing nut 190 onto at least one first bracket bolt(s) 170; step seven 507 adjustably-sliding leg stake(s) 130 through first stake sleeve 200 and second stake-sleeve 205 respectively with point end 134 of leg stake(s) 130 oriented downwardly; step eight 508 aligning through-hole 207 of second stake-sleeve 205 with user 140 preferred stake-through-hole(s) 132 of leg stake(s) 130; step nine 509 inserting R-clip(s) 199; step ten 510 using ladder 120; and step eleven 511 storing ladder 120.

It should be noted that step 507 is an optional step and may not be implemented in all cases. Optional steps of method 500 are illustrated using dotted lines in FIG. 5 so as to distinguish them from the other steps of method 500. Other optional steps may include removal of the assemblies and or adjusting, as needed (as terrains change).

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A rapid installation and removal ladder slide prevention system comprising:

at least one anti-slide assembly having;

an upper U-bracket having a plurality of first and a second upper clamp holes;

a first stake sleeve;

a first bracket bolt; and a first wing nut;

wherein said upper U-bracket has a U-shape including two arms and a connector piece connected between said two arms, such that an opening and space is created to allow a stile of a ladder to enter said space and be secured therein;

a lower U-bracket having a plurality of third and a fourth lower clamp holes;

a second stake sleeve having a through-hole;

a second bracket bolt;

a second wing nut; and an R-clip; and wherein said lower U-bracket has a U-shape including two arms and a connector piece connected between said two arms, such that an opening and space is created to allow a stile of a ladder to enter said space and be secured therein; and a leg stake having;

a point end and a top end; and a plurality of stake-through-holes wherein one each said anti-slide assembly is removably attached to each ladder leg, each said anti-slide assembly being identical and interchangeable to attach to either said ladder leg;

wherein said upper U-bracket is removably fastened to said ladder leg near a bottom portion of said ladder leg;

wherein said first stake sleeve is non-removably attached to an outside back portion of said upper U-bracket such that said first stake sleeve is oriented vertically;

wherein said first bracket bolt is horizontally inserted through said upper clamp holes of said upper U-bracket such that said first wing nut is able to be threadably fastened onto said first bracket bolt to biasingly clamp said upper U-bracket to said ladder leg;

wherein said lower U-bracket is removably fastened to said ladder leg vertically beneath said upper U-bracket;

wherein said second stake sleeve is non-removably attached to an outside back portion of said lower U-bracket such that said second stake sleeve is oriented vertically;

wherein said second bracket bolt is horizontally inserted through said lower clamp holes of said lower U-bracket such that said second wing nut is able to be threadably fastened onto said second bracket bolt to biasingly clamp said lower U-bracket to said ladder leg;

wherein said point end of said leg stake is slideably inserted vertically downward first through said first stake sleeve and secondly through said second stake sleeve aligning said through-hole of said second stake sleeve with a single said stake-through-hole of said leg stake and biasingly inserting said R-clip through said through-hole and said stake-through-hole to removably secure said leg stake to said ladder leg; and wherein said at least one anti-slide assembly is useful for removably and adjustably attaching to said ladder leg(s) such that said at least one leg stake is able to penetrate a ground surface to prevent a bottom of a ladder from unintentionally sliding while a user is climbing thereon, thereby adding to a safety of said user.

2. The rapid installation and removal ladder slide prevention system of claim 1 wherein said point end of said leg stake is able to be adjusted vertically upward and alternately vertically downward in relation to a foot of said ladder leg via said plurality of said stake-through-holes, said leg stake slideably locked into place via said R-clip.

3. The rapid installation and removal ladder slide prevention system of claim 2 wherein said at least one leg stake is oriented adjacently parallel to a narrow edge of said ladder leg when said at least one anti-slide assembly is attached to said ladder.

4. The rapid installation and removal ladder slide prevention system of claim 3 wherein said at least one leg stake is about ½ inch in diameter and about 18 inches long such that said upper U-bracket and said lower U-bracket are able to be installed on different said ladders having various spacing requirements.

5. The rapid installation and removal ladder slide prevention system of claim 2 wherein said leg stake comprises about 6 stake-through-holes.

6. The rapid installation and removal ladder slide prevention system of claim 5 wherein said stake-through-holes are spaced about 2 inches apart.

7. The rapid installation and removal ladder slide prevention system of claim 6 wherein said point end of said leg stake comprises a sharpened end such that said point end is able to penetrate a ground surface.

8. The rapid installation and removal ladder slide prevention system of claim 1 wherein said upper U-bracket and said lower U-bracket each comprise an inner arm and an outer arm.

9. The rapid installation and removal ladder slide prevention system of claim 8 wherein said plurality of first clamp holes of said inner arm correspond with said plurality of second clamp holes of said outer arm of said upper U-bracket and said lower U-bracket respectively such that said upper U-bracket and said lower U-bracket are each able to be fastened to various sizes of said ladder legs respectively via said first bracket bolt and said second bracket bolt.

10. The rapid installation and removal ladder slide prevention system of claim 8 wherein said upper U-bracket and said lower U-bracket each comprise an open end such that said upper and said lower U-bracket are able to be slideably placed onto said ladder leg.

11. The rapid installation and removal ladder slide prevention system of claim 10 wherein a width of an inside dimension between said inner arm and said outer arm of said upper U-bracket and said lower U-bracket is about equal to an outside dimension of a thickness of said ladder leg such that said upper U-bracket and said lower U-bracket comprise a loose frictional fit on said ladder leg.

12. The rapid installation and removal ladder slide prevention system of claim 1 wherein said inner arm and said outer arm of said upper U-bracket each comprise about 3 sets of said first and said second upper clamp holes.

13. The rapid installation and removal ladder slide prevention system of claim 1 wherein said inner arm and said outer arm of said lower U-bracket each comprise about 3 sets of said third and said fourth lower clamp holes.

14. The rapid installation and removal ladder slide prevention system of claim 13 wherein said upper U-bracket and said lower U-bracket are oriented perpendicular to a longitudinal edge of said ladder leg when said at least one anti-slide assembly is attached to said ladder.

15. The rapid installation and removal ladder slide prevention system of claim 1 wherein at least one said anti-slide assembly fastened to each said ladder leg is able to provide an added safety for said user.

16. The rapid installation and removal ladder slide prevention system of claim 1 wherein said at least one anti-slide assembly is able to be installed on said ladder without a use of a hand tool.

17. The rapid installation and removal ladder slide prevention system of claim 1 wherein a centerline of said first stake sleeve and said second stake sleeve are non-removably and perpendicularly attached to said outside back portion of said upper U-bracket and said lower U-bracket respectively.

* * * * *